United States Patent [19]

Adamek et al.

[11] Patent Number: 4,993,855

[45] Date of Patent: Feb. 19, 1991

[54] PRINTING HEAD FOR A NEEDLE PRINTER

[75] Inventors: Manfred Adamek, Kirchen-Freusburg; Heinz-Gerhard Schock, Bad Endbach, both of Fed. Rep. of Germany

[73] Assignee: U.S. Philips Corporation, New York, N.Y.

[21] Appl. No.: 407,382

[22] Filed: Sep. 14, 1989

[30] Foreign Application Priority Data

Sep. 27, 1988 [DE] Fed. Rep. of Germany ..... 3832670

[51] Int. Cl.[5] ..... B41J 2/235

[52] U.S. Cl. ..... 400/124; 101/93.05

[58] Field of Search ..... 400/124, 124 VI; 101/93.05

[56] References Cited

U.S. PATENT DOCUMENTS

| | | | |
|---|---|---|---|
| 4,010,835 | 3/1977 | Martin | 101/93.05 |
| 4,031,992 | 6/1977 | Murat et al. | 400/124 |
| 4,190,845 | 2/1980 | Cooper et al. | 400/126 |
| 4,408,907 | 10/1983 | Bernardis | 400/124 |
| 4,459,051 | 7/1984 | Kawai | 400/124 |
| 4,475,826 | 10/1984 | Dürr et al. | 400/124 |
| 4,640,633 | 2/1987 | Hebert | 400/124 |

FOREIGN PATENT DOCUMENTS

| | | | |
|---|---|---|---|
| 58-72488 | 11/1984 | Japan | 400/124 |
| 266105 | 2/1986 | Japan | 400/124 |

OTHER PUBLICATIONS

IBM Technical Disclosure Bulletin, "Rotatable Wire Matrix Printhead", W. J. Thornhill, vol. 24, No. 10, Mar. 1982, pp. 4981–4982.

*Primary Examiner*—Edgar S. Burr
*Assistant Examiner*—Joseph R. Keating
*Attorney, Agent, or Firm*—William Squire

[57] ABSTRACT

A printing head for a needle printer includes a cylindrical switching head, rotatably arranged in the front region of the printing head and a guide piece for holding printing needles extending substantially perpendicularly to the printing direction. The cylindrical switching head accommodates the guide piece 2 is journalled through a conical support in a central inner bore of the printing head is in rotation by abutments and is held by a holding clamp.

13 Claims, 5 Drawing Sheets

PRINTING HEAD FOR A NEEDLE PRINTER

BACKGROUND OF THE INVENTION

1. Field of the Invention

The invention relates to a printing head for a needle printer, comprising a switching head, which is rotatably arranged in the front region and has a guide piece for holding printing needles extending substantially perpendicularly to the printing direction.

2. Description of Related Art

Such a construction is described, for example, in German patent application No. 24 59 254. The known printing head is mounted on a carriage and is movable in the printing direction. The rotation of the switching head arranged on the front side of the printing head is effected through an electromagnet, which cooperates with a return spring and whose armature engages the switching head from the outside. The guide piece fixedly journalled in the switching head in this known construction comprises a row (column) of printing needles arranged above each other. When the magnet is not excited, the return spring holds the switching head in a first extreme position, in which the row of printing needles is arranged perpendicularly to the direction of movement. In this position, perpendicular symbols can be written and printed, respectively. Upon excitation of the magnet, the switching head is rotated into a second extreme position, in which the row of needles encloses an angel different from 90° with the direction of movement. In this position, symbols inclined in one direction can be written and printed, respectively. The switching head can also be rotated in the other direction so that correspondingly symbols inclined in another direction can be written. According to need, the switching head can also be adjusted at inclination angeles of different values so that symbols are obtained which are inclined forwards or backwards to a different extent.

SUMMARY OF THE INVENTION

The invention has for its object to reduce the efforts for the manufacture and the operation of a printing head of the kind mentioned in the opening paragraph and to increase the reliability, more particularly with a view to the rotatability of the switching head. This object is achieved in that the cylindrical switching head accommodating the guide piece is journalled through conical support in a centric inner bore of the printing head so as to be limited by abutments and is held by holding means. Such a journalling of the switching head through a conical support within the cylindrical bore of the printing head offers a high reliability and a safe guiding of the switching head during its rotary movement within the printing head. The risk of contamination of the conical surfaces is reduced to a minimum because these surfaces are located within the bore of the printing head so as to be protected. The abutment limitations becoming operative upon rotation of the switching head in the circumferential direction can be constituted in a simple manner by abutment surfaces at the printing head.

According to the invention, the switching head is held in the inner bore by means of a clamp, which is supported o the one hand from the switching head and on the other hand from the printing head. This permits of simply mounting the switching head in that the clamp is simply inserted into corresponding grooves, recesses or openings. The risk of canting of the switching head located in the inner bore of the printing head can be reduced in that the end of the switching head located in the inner bore is provided with a supporting plate, which engages by its outer boundary edges into recesses of the inner bore. A simple rotation of the switching head may be attained, for example, in tnat the switching head is provided with an adjustment lever projecting radially outwards and in that the abutment limitation is constituted by boundary surfaces of the printing head extending in the circumferential direction. Thus, a simple manual operation suffices to change the printing head over from one mode of operation to another mode of operation. Effectively, this adjustment lever is held by a device provided on the carriage in the respective final position. In an embodiment of the invention, the adjustment lever is secured to the part of the switching head located n the inner bore of the printing head and traverses a recess of the printing head, its boundary surfaces serving as abutment limitation for the adjustment lever. The abutments in the circumferential direction are located in the interior of the housing of the printing head so as to be protected. In a further embodiment of the invention, the adjustment lever is secured on the outside of the switching head and projects radially outwards, housing abutments of the printing head extending the circumferential direction being formed as abutment limitation for the adjustment lever. This kind of abutment limitation by abutments fixedly arranged on the housing permits an exact association between the guide piece fixedly arranged in the switching head on the one hand and the housing of the printing head on the other hand. The risk of contamination of the conical support allowing a reliable guiding can be reduced in that the switching head is connected to an annular sheath, which surrounds it at a certain distance, surrounds the printing head whilst leaving an air gap and extends parallel to the axis of the switching head. A simple manufacture is obtained in that the switching head in accordance with the invention and its sheath and the adjustment lever are made in one piece.

A preferred embodiment of the invention consists in that the guide piece has two parallel extending perpendicular rows of needles, whose position is tuned in such a manner to the two spacer limitations extending in the circumferential direction that upon engagement of the adjustment lever with one abutment the needles of one row cover the hiatuses of the other row and that upon engagement of the adjustment lever with the other abutment the needles of both rows lie at the same level in the writing direction. If the needles of both rows of needles lie at the same level, the printing head is suitable for high-speed writing. In the case of needles located on hiatuses, on the contrary, a so-called near-letter quality writing can be obtained. The technique of readjustment of high-speed writing to near-letter quality writing, and conversely, is known per se. This change-over tanks place according to the prior art, for example, by subdivided guide pieces, the rows of needles being moved with respect to each other in such a manner that the needles are located either on hiatuses or at the same level (EP 0 139 190). Another known kind of displacement consists in that in a construction in which the guide piece is fixedly journalled within the printing head, the whole printing head must be rotated about its axis into a "high-speed writing" position or into a "near-letter quality writing" position. The first-mentioned known construction has the disadvantage of small switching paths and a high sensitivity to tolerances; further, the amount of wear at the switching edges is comparatively large and a large number of electrical components is required. In the second construction mentioned, large masses (the whole printing head must be moved; further, a poor heat transition between the printing head and the carriage is obtained because in this case only a point contact occurs.

The aforementioned preferred embodiment, in which the two end abutments are limitation abutments, can be modified in that the adjustment lever can be snaplocked at least one further point, for example midway between the two outer abutment limitations. This may be advantageous, for example, for more than two adjacent rows of needles.

BRIEF DESCRIPTION OF THE DRAWINGS

In the drawing.

FIGS. 1 and 2 show diagrammatically the arrangement of two rows of needles with high-speed writing and with near-letter quality writing.

FIG. 3 shows a side elevation partly cut away of a printing head,

FIG. 4 shows a sectional view A—A according to FIG. 3,

FIG. 5 shows a side elevation partly cut away of a differently constructed printing head, and FIG. 6 shows an associated sectional view B—B according to FIG. 5.

DESCRIPTION OF THE PREFERRED EMBODIMENT

Figure 2:
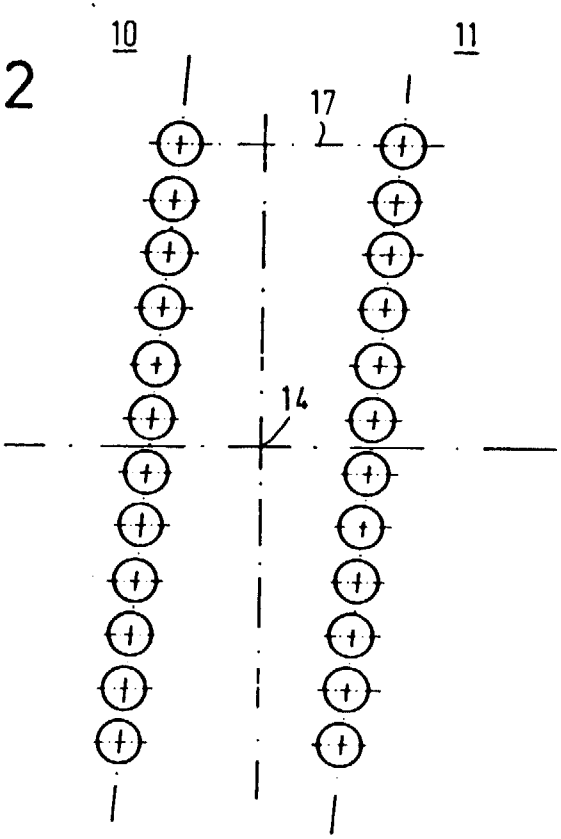
FIGS. 1 to 6 show diagrammatically embodiments of the article according to the invention.
Figure 1:
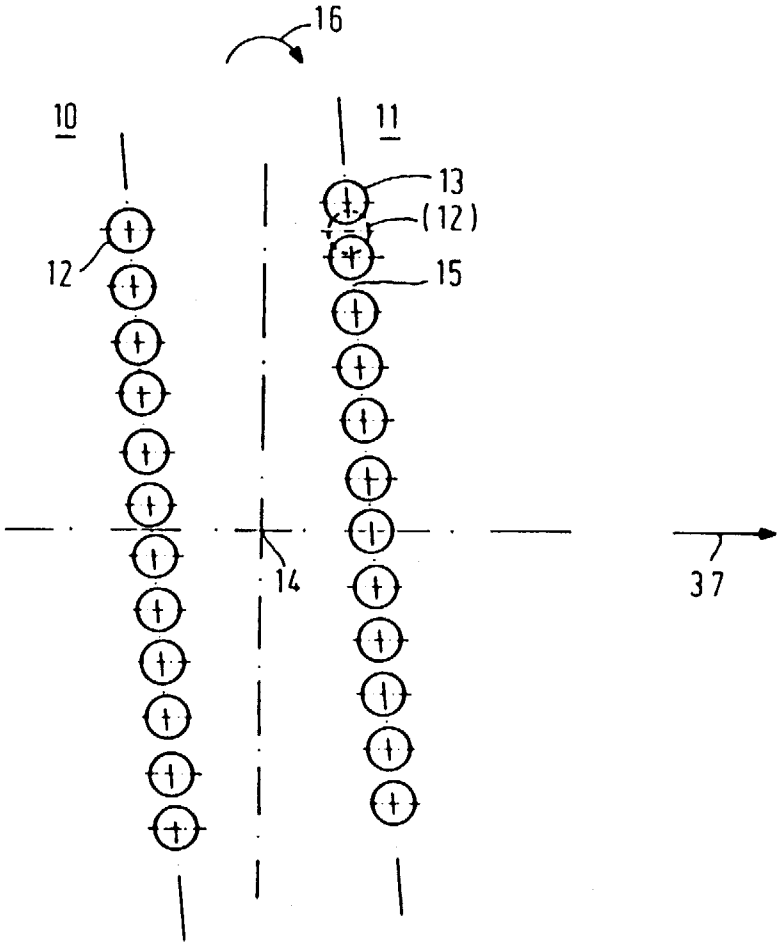

FIGS. 1 and 2 show two rows of needles 10 and 11, which each have several needles 12, 13 arranged in columns below each other. The rows of needles 10 and 11 are arranged in a guide piece not shown in FIGS. 1 and 2 and are rotatable bout a point of rotation 14. Also more than two rows of needles may be present. According to FIG. 2, the two rows of needles 10 and 11 are arranged so that during printing the rows of needles 10 cover he hiatuses 15 of the second row of needles 11. Thus, a so-called near-letter quality writing is possible. For a high-speed writing, a rotation of the rows of needles 210 and 11 takes place about the point of rotation 14 in the direction 16 so that according to FIG. 2 the needles 12, 13 of both rows of needles 10 and 11 lie at the same level 17. By this modification, it is possible to print with the same horizontal printing raster at a higher carriage speed.

Figure 3:
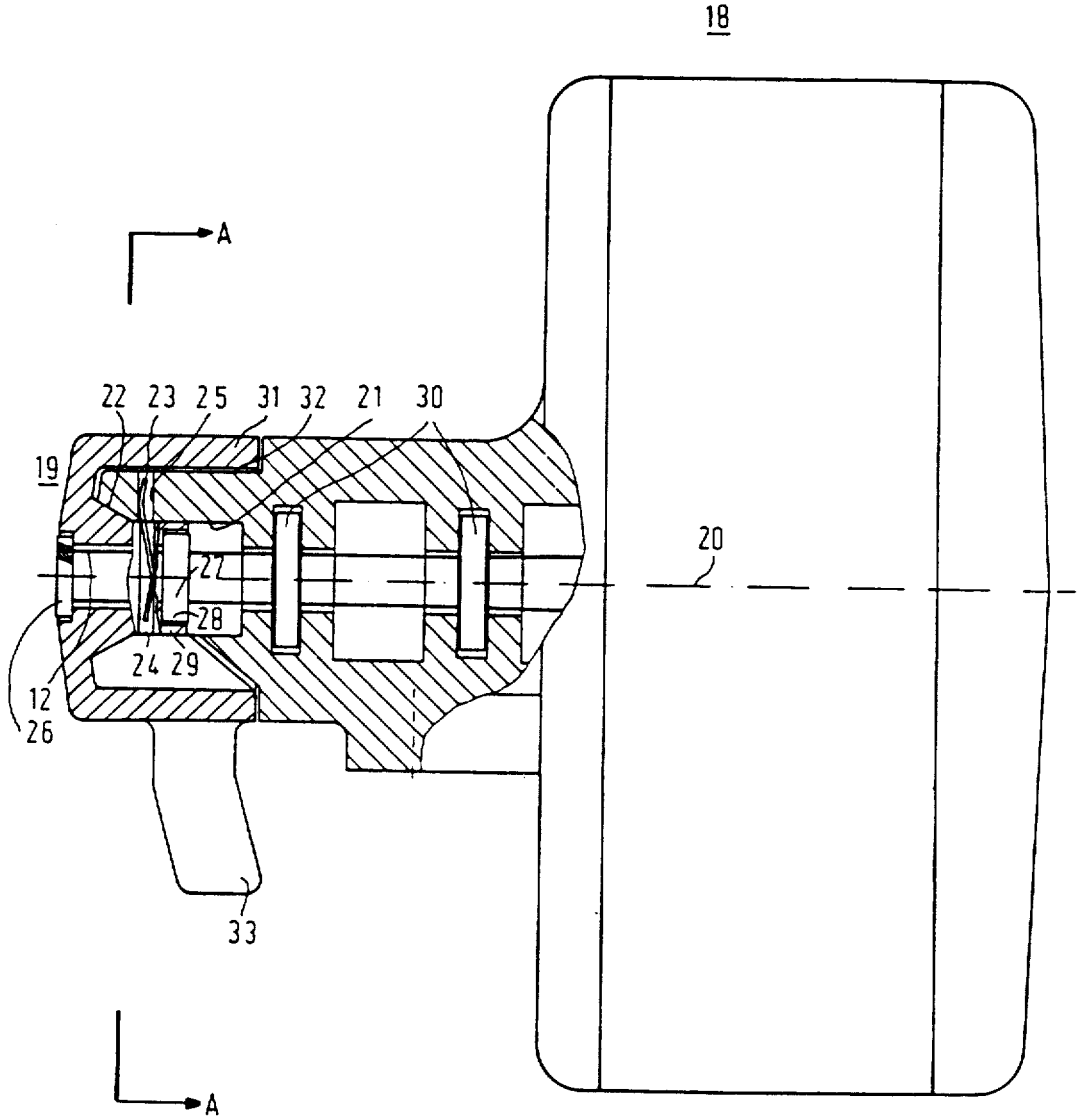
Figure 4:
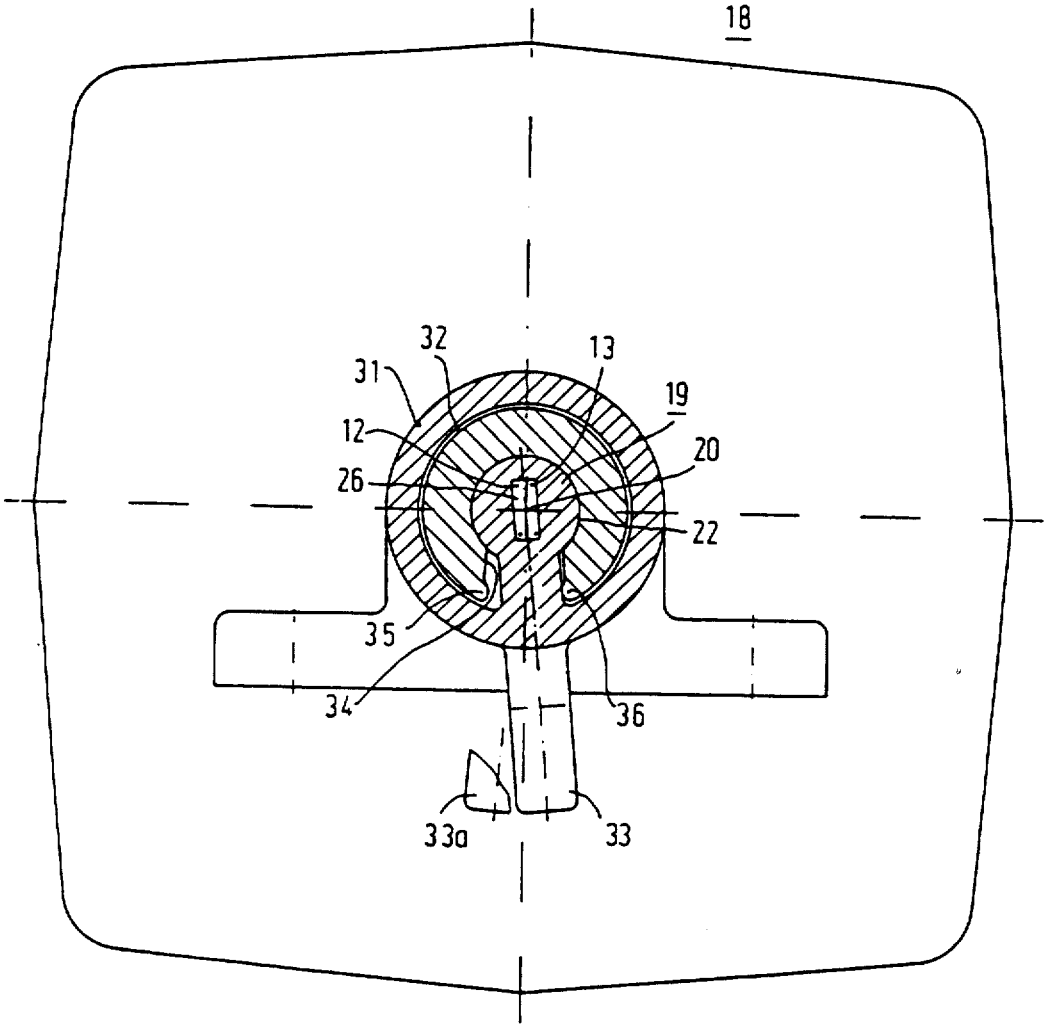

According to FIGS. 3 and 4, a printing head 18, which is movable on a carriage not shown in a printing direction 37, is provided on its front side with a rotatably arranged cylindrical switching head 19. Reference numeral 20 designates the central axis of the printing head 18 and of the switching head 19. The cylindrical switching head 19 is located in an inner bore 21 having conical egress in the printing head 18 and is journalled on the printing head through a inner conical member of support 22 which mates with conical egress. The switching head 19 is held by clamp 234, which is supported on the one hand from grooves 24 of the switching head 19 and on the other hand from openings 25 of the printing head 18 and thus presses the switching head 19 through the conical support 22 exactly against the printing head 18. Reference numeral 26 designates a guide piece, which is fixedly journalled within the switching head 19 and has in this embodiment two rows 10 nd 11 of printing needles comprising the printing needles 12 and 13. The printing needles of the rows of needles 10 and 11 extend through the inner bore into the housing of the printing head 18 and are connected here to the armatures of electromagnets not shown. The switching head 19 is provided at the end located in the inner bore 21 with a supporting plate 27, which is supported with its outer boundary edges 28 in recesses 29 of the switching head 19. Thus, the printing needles 12, 13 are prevented from being canted and hence being jammed upon rotation of the switching head 19. Reference numeral 30 designates further guide holders for the printing needles 12, 13 within the printing head 18.

The switching head 19 is connected to an annular sheath 31, which surrounds the printing head 18 whilst leaving a gap 32. As a results, the risk of contamination for the cone seat of support 22 is considerably reduced. Viewed in longitudinal section, switching head 19 therefore has substantially the shape of a pot, the outer edge of the pot being constituted by the sheath 31 and the bottom of the pot being provided with an outwardly projecting cylindrical part for accommodating and holding the guide piece 26.

The switching head 19 is provided with an adjustment lever 33, which points radially outwards and traverses a recess 34 of he housing of the printing head. The recess 34 constitutes two outer abutment limitations 35, 36 for the adjustment lever 33. FIG. 4 shows the adjustment lever 33 engaging the right hand abutment limitation 36; reference numeral **33*a* denotes the position of the adjustment lever 33, in which in this position, the lever 33 engages the left hand abutment limitation 35**.

The arrangement and the position of the needles 12 and 3 of the rows of needles 10 and 11 are tuned to the two spacer limitations 35, 36 so that upon engagement of the adjustment lever 33 with the abutment 36 the needles 12 and 13 each of the rows 10 and 11 are located on hiatuses of the other row, FIG. 1, whereas upon engagement of the adjustment lever **33*a* with the limitation abutment 35 the needles 12 and 13 of both rows of needles 10 and 11 lie at the same level 17 (high-speed writing FIG. 2**.

Figure 5:
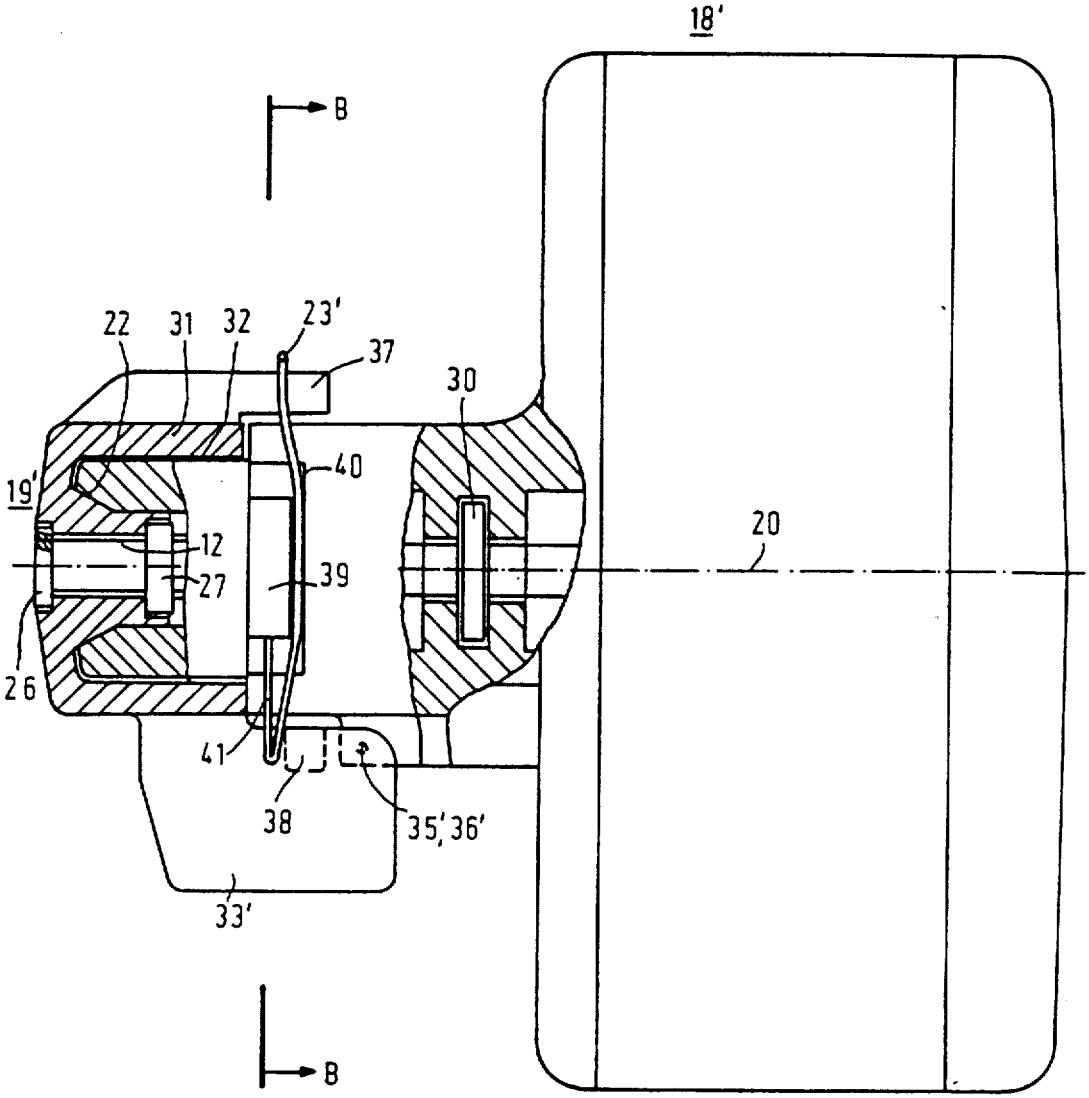
Figure 6:
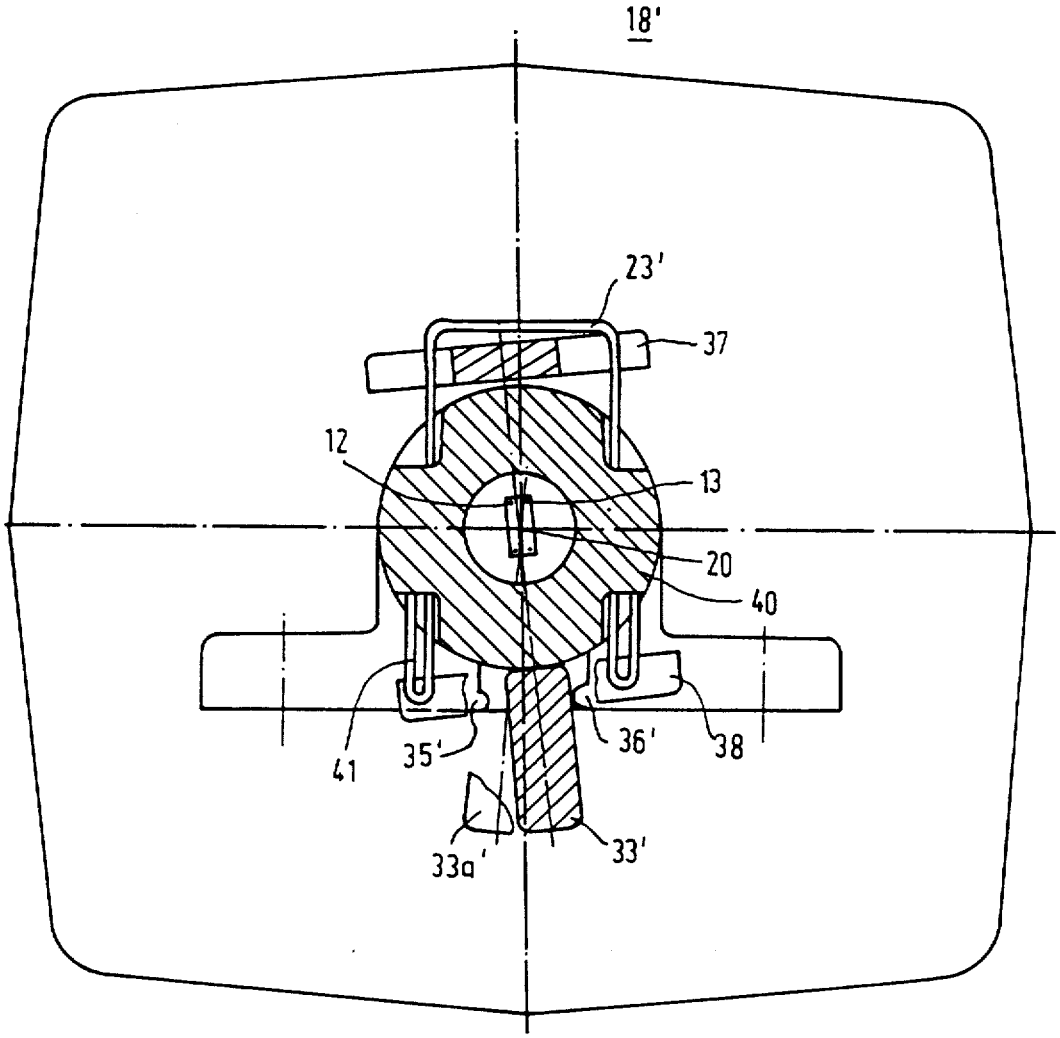

In the embodiment shown in FIGS. 5 and 6, the construction of the switching head with the associated adjustment lever and the means for securing the switching head are slightly modified. The stitching head 19' is provided with flaps 37, 38 radially extending outwards and now had an adjustment lever 33', which is secured on the outside of the switching head 19' and cooperates with boundary surfaces 35', 36' directed radially outwards and extend in the circumferential direction of the printing head 18'. The clamp used is an outer clamp 23', which is supported on the one hand from the flaps 37, 38 and on the other hand from an abutment 39 in the housing of the printing head. Due to the fact that the abutment limitations 35', 36' are located radially further outwards, a smaller angle error because of manufacturing tolerances is obtained. The clamp 23' said introduced through a groove 40. Reference numeral 41 designates a member blocking the extraction of the clamp 23'.

What is claimed is:

1. A printing head for a needle printer comprising:

a plurality of print needles a print head having a print end and a bore in communication with the end, said bore having an axis and a conical egress formed at the end of said bore and about said axis, said plurality of print needles extending through said bore and said conical egress;

a switching head including guide means for receiving and securing said plurality to print needles to the switching head said plurality of print needles extending along said axis, said switching head including a base member for receiving said needles therethrough and an inner conical member extending from the base member and mating with and seated in said conical egress for rotation relative to said conical egress such that the switching head is rotatable about said axis within said bore relative to said print head to thereby rotate said needle array about said axis between first and second positions.

2. The printing head of claim 1 including a clamp for releasably securing the switching head to the print head.

3. The printing head of claim 2 wherein said switching head has at least one groove, said print head including a head member having an opening, said clamp mating with said at least one groove and opening to secure the switching head to the print head.

4. The printing head of claim 2 wherien said print head includes flaps extending outwardly therefrom and said switching head includes an abutment extending therefrom, said clamp securing the switching head to the print head externally said member via said flaps and abutment.

5. The printing head of claim 1 further including a lever secured to said switching head projecting radially outwardly from said print head and abutment means secured to said print head for limiting the angular rotation of said switching head relative to said print head.

6. The printing head of claim 5 wherein the print head has surfaces defining a recess extending radially from said axis, said lever passing through said recess, said lever and recess being dimensioned to form said abutment means such that the recess surfaces limit the relative rotation displacement of the switching head to the print head.

7. The printing head of claim 5 wherein said switching head includes an annular outer member extending from the base member and juxtaposed with said bore and a lever secured to and extending radially outwardly from said outer member, said abutment means including abutments extending from said print head and which abut said lever for said limiting.

8. The printing head of claim 1 wherein said switching head has an end located within said bore, said latter end having recesses, said printing head including a supporting plate secured to said end recesses within said bore.

9. The printing head of claim 7 wherien said switching head has an end located within said bore, said latter end having recesses, said printing head including a supporting plates secured to said end recesses within said bore.

10. The printing head according to any of the preceding claims including an annular sheath extending from said base member juxtaposed with said inner conical member and surrounding the print head at said print head end concentric with said axis.

11. The printing head of claim 10 wherien said sheath, base member and inner member are an integral unitary structure.

12. The printing head of claim 1 adapted to move in a print direction, said printing head further including two parallel extending columns of spaced print needles forming said array secured to said guide means, the needles of one column being spaced from one another a first spacing, the needles of the other column being spaced from on another a second spacing, the spacing and orientation of the needles in the two columns being such that in the first position, the needles are aligned in parallel rows of two needles in each row, the rows extending in said print direction normal to said two columns and to said axis, and in the second position, the needles of one column are aligned with the spaces between the needles of the other column in said print direction.

13. The printing head of claim 10 adapted to move in a print direction, said printing head further including two parallel extending columns of spaced print needles forming said array and secured to said guide means, the needles of one column being spaced from one another a first spacing, the needles of the other column being spaced form one another a second spacing, the spacing and orientation of the needles in the two columns being such that in the first position, the needles are aligned in parallel rows of two needles in each row, the rows extending in said print direction normal to said two columns and to said axis, and in the second position, the needles of one column are aligned with the spaces between the needles of the other column in said print direction.

* * * * *